US005774142A

United States Patent [19]

Nguyen et al.

[11] Patent Number: 5,774,142

[45] Date of Patent: Jun. 30, 1998

[54] USE OF A SECONDARY SPITTOON FOR WASTED INK CONTAINMENT

[75] Inventors: Chan Nguyen, San Diego, Calif.; Alan Shibata, Camas, Wash.

[73] Assignee: Hewlett-Packard Company, Palo Alto, Calif.

[21] Appl. No.: 774,711

[22] Filed: Jan. 3, 1997

Related U.S. Application Data

[63] Continuation of Ser. No. 342,186, Nov. 18, 1994, abandoned.

[51] Int. Cl.[6] ..... B41J 2/165

[52] U.S. Cl. ..... 347/35; 347/3; 347/36

[58] Field of Search ..... 347/3, 29, 30, 347/35, 36, 90

[56] References Cited

U.S. PATENT DOCUMENTS

| | | | |
|---|---|---|---|
| 4,492,258 | 1/1985 | Lichtenstein et al. . | |
| 4,872,026 | 10/1989 | Rasmussen et al. | 346/140 |
| 4,965,596 | 10/1990 | Nagoshi et al. | 347/36 |
| 5,300,958 | 4/1994 | Burke et al. | 347/28 |
| 5,404,229 | 4/1995 | Ono et al. | 347/3 |

FOREIGN PATENT DOCUMENTS

| | | | |
|---|---|---|---|
| 55-74886 | 6/1980 | Japan . | |
| 356086766 | 7/1981 | Japan | 347/90 |
| 58-96561 | 6/1983 | Japan | 347/36 |
| 61-24457 | 2/1986 | Japan | 347/36 |

*Primary Examiner*—John E. Barlow, Jr.

[57] ABSTRACT

An apparatus and method are provided to prevent the overflow of waste ink from a primary spittoon used in a service station of a thermal ink-jet device, such as a facsimile machine. An opening is defined in a wall of the primary spittoon such that when the waste ink level within the primary spittoon reaches the opening, the waste ink issues from the opening for collection by a secondary spittoon. A passageway may be employed to route the ink from the opening to the secondary spittoon, with the passageway preferably represented by a rib formed externally on the primary spittoon wall. By employing the method of the present invention, one avoids the potential contamination of the internal workings of the thermal ink-jet device caused by the unchecked overflow of ink from the primary spittoon.

19 Claims, 3 Drawing Sheets

USE OF A SECONDARY SPITTOON FOR WASTED INK CONTAINMENT

CROSS-REFERENCE TO RELATED APPLICATION

This is a continuation of application Ser. No. 08/342,186 filed on Nov. 18, 1994, now abandoned.

The present application is related to application Ser. No. 08/241,813, filed May 12, 1994, which discloses and claims a method of preventing the formation of dried ink in a spittoon for collecting waste ink by employing an absorber wetting agent for the absorber material in the bottom of the spittoon, and further disclosing and claiming the facsimile machine employing the absorber wetting agent. The present application is directed to providing a secondary spittoon.

TECHNICAL FIELD

The present invention relates to facsimile machines that employ ink-jet engines, and, more particularly, to such facsimile machines including a service station for servicing ink-jet print cartridges.

BACKGROUND ART

Ink-jet printers of the type disclosed and claimed in U.S. Pat. No. 4,872,026, issued Oct. 3, 1989, and assigned to the same assignee as the present application, commonly include a service station for storing the pen(s) during non-use and for performing other operations, such as priming or clearing the nozzles of the pen, sealing the printhead during non-printing operations, and cleaning the printhead.

Dealing with any ink removed from the pen by priming can be messy. The solution posed in the above-mentioned U.S. Pat. No. 4,872,026 utilized both a spittoon and a cap chamber. All nozzles in the printhead are cleared periodically by firing into the spittoon during printing, and, in ink-jet printers of the type disclosed and claimed in U.S. Pat. No. 4,872,026, all nozzles are fired into the cap chamber each time the cap is engaged to cover the printhead portion of the pen during non-printing operations. Firing into the cap chamber provides a reservoir of ink that acts as a moisture source to keep the printhead from drying up during printing. Attached to the bottom of the cap chamber is a peristaltic pump, which comprises a plastic tube, a roller, and a pump body. One end of the tube is attached to the bottom of the cap chamber, while the other end terminates in free space, over an absorber pad. The absorber pad is used as a holding vessel while any ink that reaches the absorber pad evaporates into the air. The peristaltic pump serves to prime the pen.

The ink-jet engine employed in ink-jet printers, such as that described above, has been successfully utilized in plain paper facsimile machines. Such facsimile machines are being introduced into the market, and incorporate many of the features disclosed in the above-identified U.S. Pat. No. 4,872,026 and other patents related to ink-jet printers.

During normal operation of a thermal ink-jet pen, spitting is required to clear the nozzles of partially evaporated ink before printing. In addition to spitting to clear away ink, the nozzles also spit heavily (on the order of 300,000 drops) when the pen is engaged in testing for an out-of-ink condition. Whatever the reason for nozzle-spitting, the wasted ink so generated is contained in a reservoir or "spittoon". The volatile portion, for example, the vehicle, of the ink in the spittoon will then evaporate over time. In order to speed up evaporation, an absorbent material is placed in the spittoon to spread out the ink and to increase its exposed surface area.

An absorber wetting agent specifically designed to wet the absorbent material is described in a pending application entitled "Spittoon Absorber Wetting Agent", Ser. No. 08/241,813, filed May 12, 1994, in the name of Chan Nguyen, one of the co-inventors of the present invention. The absorber wetting agent of that application increases the effectiveness of the absorbent material in spreading out the ink and, as a result, prevents the formation of "stalagmites" of dried ink within the spittoon.

Even with an effective absorbent material to hasten evaporation of the volatile portion of the ink, the rate of evaporation may lag behind the rate of ink influx into the spittoon. This is a particular concern given extensive use of a thermal ink-jet pen, since such use requires frequent clearing of the nozzles, and, consequently, an increased influx of ink into the spittoon. If the volumetric rate of ink influx exceeds the volumetric rate of evaporation, the ink may overflow the spittoon, contaminating the inside of the printer.

Accordingly, there is a need for a cost-effective means to prevent the contamination of the interior of the printer by ink that overflows the spittoon.

DISCLOSURE OF INVENTION

In accordance with the invention, an apparatus and method are provided which prevent the overflow of ink from the spittoon, hereinafter termed the "primary spittoon", used in a service station of an ink-jet device. More particularly, a secondary spittoon is employed in the practice of the invention to collect ink through an opening in the primary spittoon wall. The method of the invention therefore comprises:

(a) providing a primary spittoon into which waste ink is jetted from the print cartridge, the primary spittoon comprising a container having a bottom and walls, each of the walls having a top and at least one of the walls having an opening through which the waste ink issues from the primary spittoon, thereby forming spillover ink; and (b) collecting the spillover ink issued from the primary spittoon in a secondary spittoon comprising a container having a bottom and walls.

The apparatus of the present invention is particularly directed to a facsimile machine including an ink-jet print cartridge and means for printing received transmission. The facsimile machine further includes the service station for servicing said print cartridge. The service station includes:

(a) the primary spittoon; and (b) the secondary spittoon into which the spillover ink is collected.

By employing the secondary spittoon of the present invention, one avoids the potential contamination of the internal workings of the printer caused by the unchecked overflow of ink from the primary spittoon. The method and apparatus of the present invention provide a controlled means of collecting waste ink that threatens to overflow the primary spittoon. Advantageously, the present method is easily implemented, requiring only the provision of a secondary spittoon and an opening in a wall of the primary spittoon, with a passageway between the opening and the secondary spittoon being an optional but recommended component. The simplicity of the present collection system is a cost-effective solution to the problem of overflow waste ink.

BEST MODES FOR CARRYING OUT THE INVENTION

Figure 1:
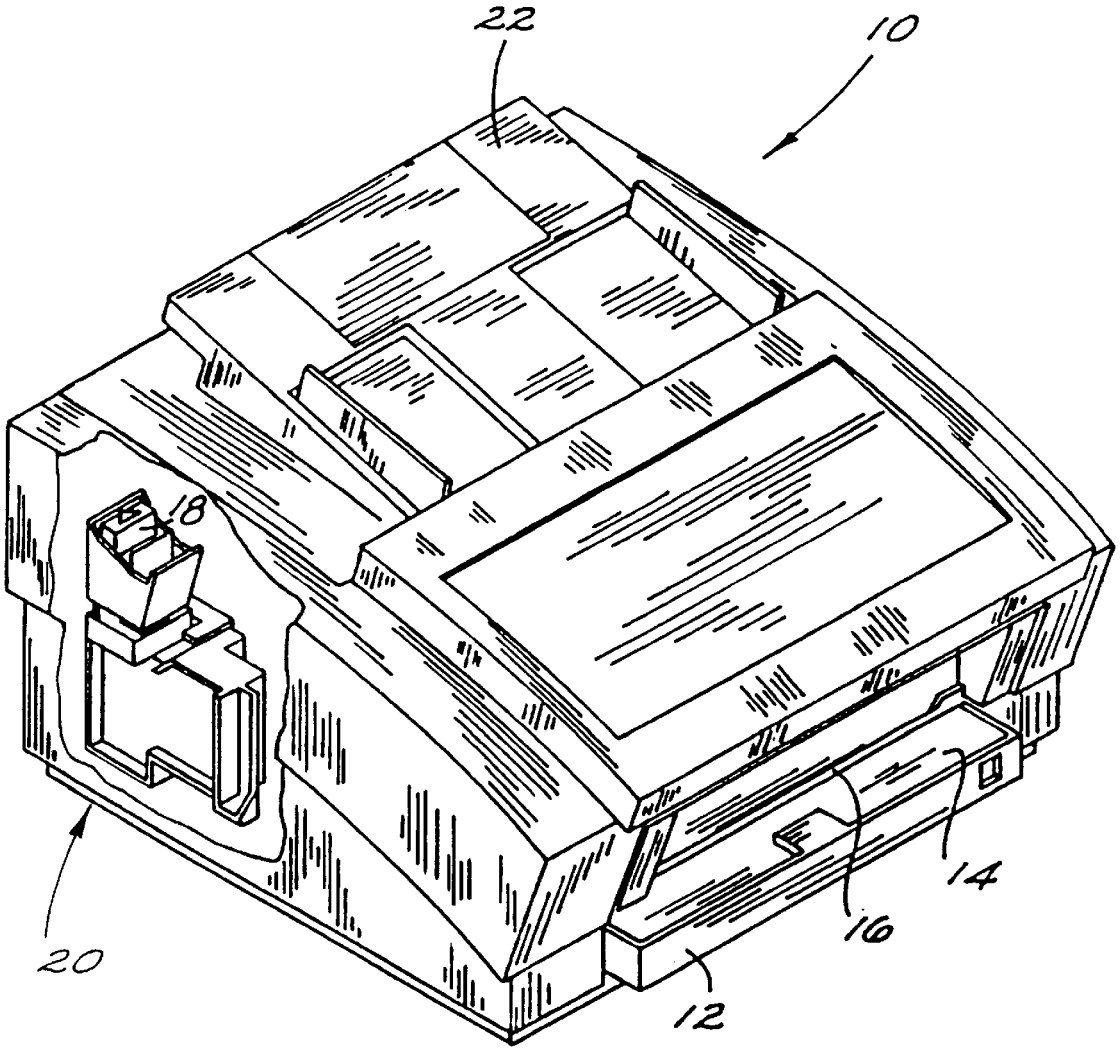
FIG. 1 is a perspective view of a plain paper facsimile machine which uses an ink-jet engine and a service station which employs both a primary spittoon as well as the secondary spittoon of the invention.

Referring now to FIG. 1, a facsimile machine 10 is shown, comprising a paper feed tray 12 for storing a supply of paper or other print medium 14 to be printed, a paper collection tray 16 for collecting the printed paper, and a print cartridge, or pen, 18. In the facsimile machine depicted in FIG. 1, one such cartridge is shown, commonly containing black ink. However, a print cartridge of another primary color (cyan, yellow, magenta) may be substituted for effect. Further, a plurality of such print cartridges, one containing black ink plus print cartridges containing the primary colors, may be employed.

The print cartridge 18 is shown residing in a service station 20, which is described in greater detail below. In FIG. 1, a portion of the facsimile machine 10 is shown broken away to expose the service station 20.

To complete the description of the facsimile machine 10, printed material is faxed to a remote location by feeding the printed material along surface 22. Other features of the facsimile machine 10, such as the platen, paper feed mechanism, printer electronics, facsimile transmission electronics, etc., are not depicted, as they are not critical to the spittoon assembly of the invention. Such other features are well-known in the art of facsimile transmission ink-jet printing. The above-referenced U.S. Pat. No. 4,872,026, for example, is exemplary of printers using ink-jet engines and service stations.

Figure 2:
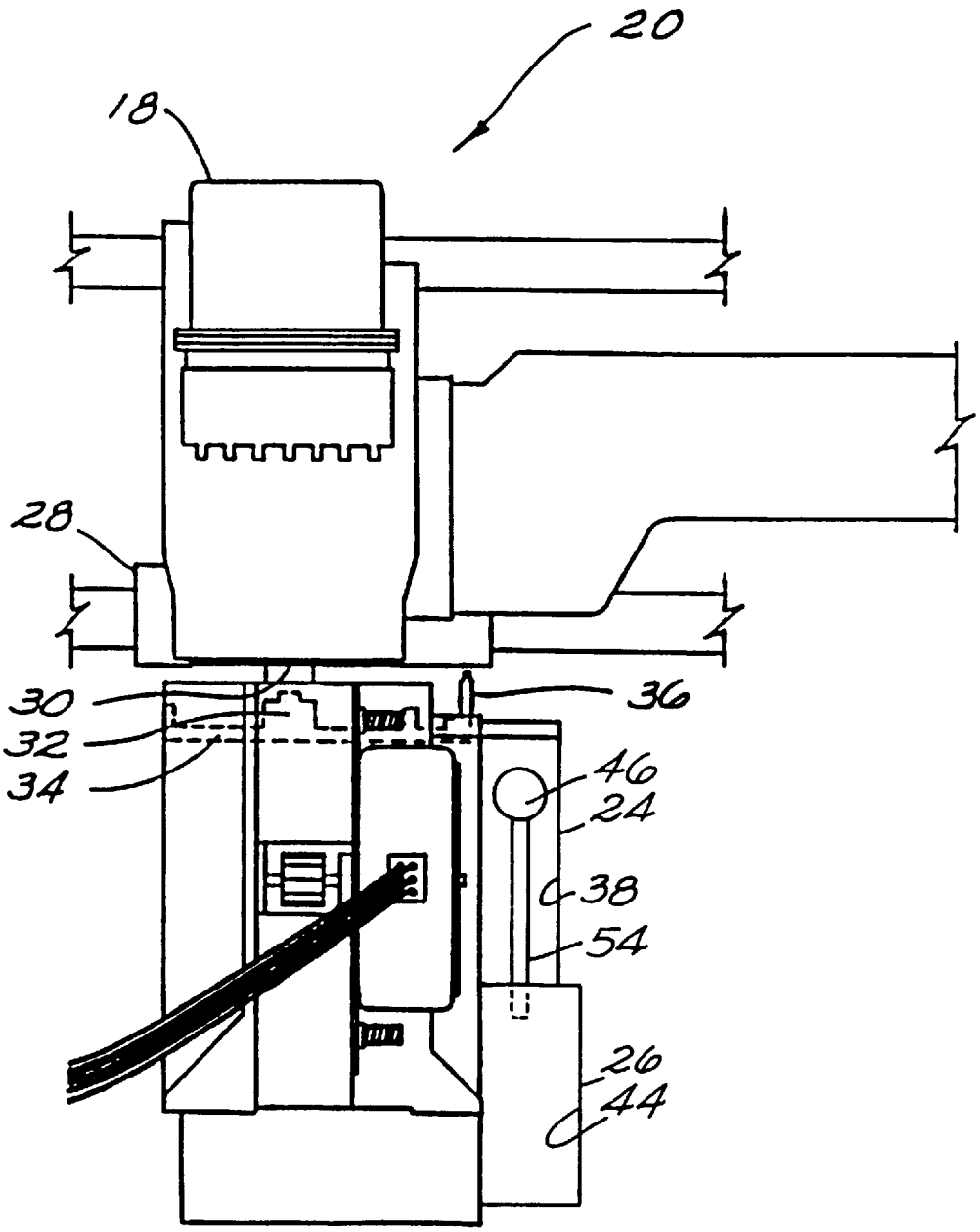
FIG. 2 is a front elevational view, in partial cross-section, of a portion of the ink-jet facsimile machine shown in FIG. 1, depicting the relationship of the secondary spittoon of the invention with respect to the machine's service station for storing and maintaining at least one ink-jet pen (black) and up to three additional pens (for color)

FIG. 2 depicts the details of the service station 20, including the primary spittoon 24 and the secondary spittoon 26 of the present invention. The service station 20 provides a variety of functions relating to the print cartridge, or pen, 18 mounted in a carriage 28. These include capping the pen orifice plate 30, through which ink is ejected onto a print medium (not shown in FIG. 2), wiping the pen orifice plate to prevent build-up of dried ink on the plate, and clearing the nozzles (not shown) in the pen orifice plate by ejecting ink into the spittoon 24.

Capping is done by positioning the pen 18 over a cap 32 which seals the nozzles and prevents drying of ink therein. A cam (not shown) moves the service station base 34 up, on which is located the cap 32.

Wiping is done by first moving the service station base 34 down as the carriage 28 moves to the wipe left position. The pen 18 is moved back and forth a preset number of times to wipe the pen orifice plate 30 with a wiper 36.

Clearing the nozzles is done by moving the pen 18 over the primary spittoon 24, which comprises a deep well chamber 38, at the bottom of which is located an absorber pad (not shown). The use of an absorber pad is disclosed and claimed in the above-mentioned application Ser. No. 08/241,813. The size of the primary spittoon 24 depends on the particular facsimile model. In one facsimile model, the size of the primary spittoon is 12 mm×12 mm×35 mm for a volume of approximately 5 $cm^3$. In another facsimile, the size of the primary spittoon is 5 mm×20 mm×30 mm for an approximate volume of 3 $cm^3$.

The method of the present invention provides a solution to the problem of waste ink overflowing the confines of the primary spittoon 24 and then contaminating the internal workings of the printer itself. An overflow of ink may occur when the volumetric rate of influx of waste ink into the primary spittoon exceeds the volumetric rate of evaporation from the primary spittoon, creating a net influx into the primary spittoon. An increase in the amount of waste ink jetted into the primary spittoon may be caused by such circumstances as extensive use of the printer. Conversely, a decrease in the evaporation rate may be caused by employment of an ineffective absorbent material or the presence of high humidity, among other circumstances. At any rate, given a sustained net influx into the primary spittoon, the waste ink will eventually overflow the primary spittoon.

Figure 3:
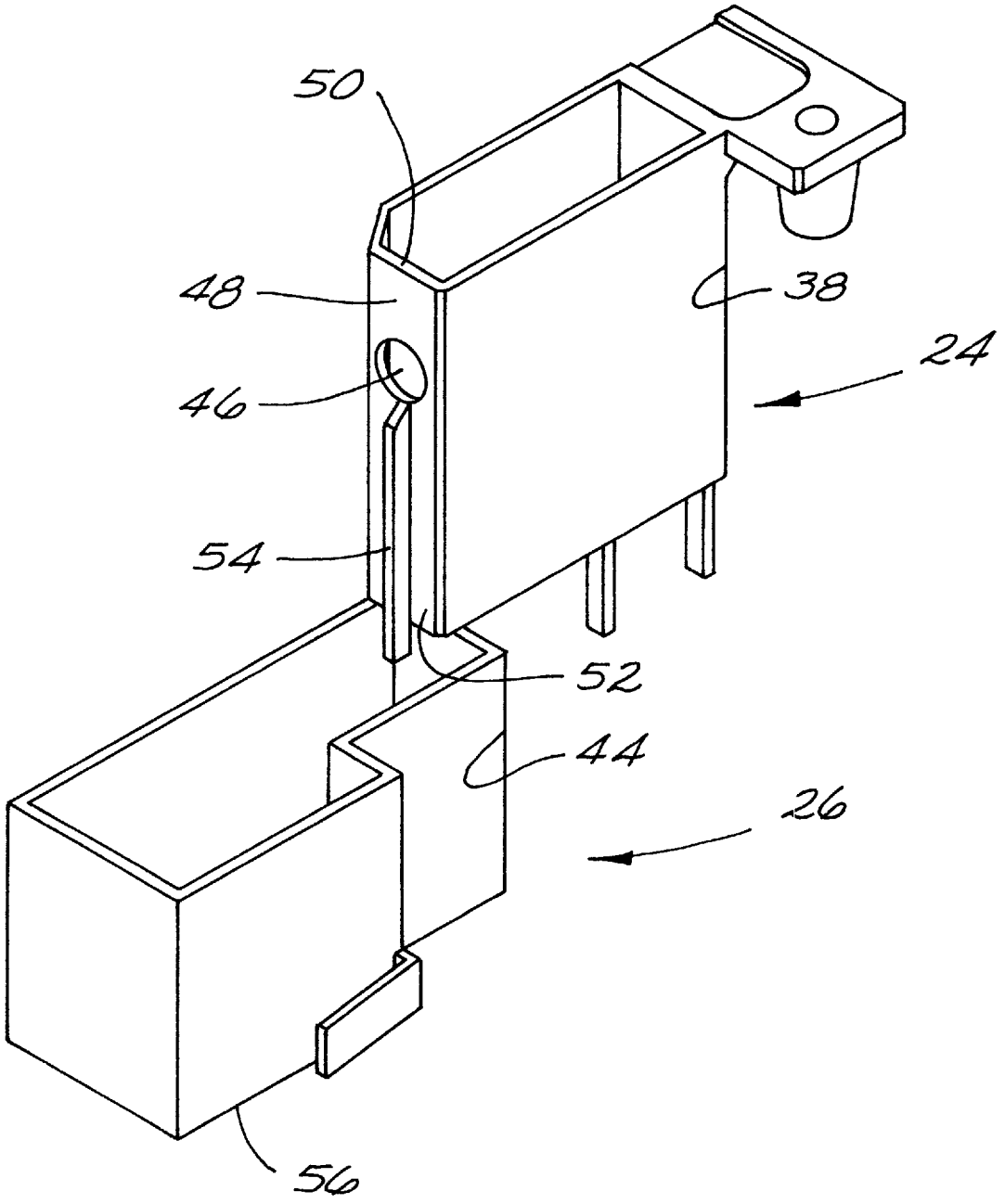
FIG. 3 is an enlarged perspective view illustrating the preferred relationship between the secondary spittoon of the invention and the primary spittoon.

In the practice of the invention, the secondary spittoon 26 is employed to collect waste ink when a net influx into the primary spittoon 24 threatens to cause an ink overflow. FIG. 3 depicts the spatial relationship between the primary spittoon 24 and the secondary spittoon 26. The secondary spittoon 26 comprises a deep well chamber 44. The shape of the secondary spittoon 26 depends on the particular facsimile model and the particular primary spittoon 24 employed therein, although a rectilinear shape is preferable. The capacity of the secondary spittoon 26 should exceed that of the primary spittoon 24, and preferably the capacity of the secondary spittoon is at least twice the capacity of its associated primary spittoon. It is contemplated that the secondary spittoon 26 should have a capacity on the order of between 10 and 20 $cm^3$.

The secondary spittoon 26 may be constructed of any material suitable for the collection of ink, such as the material used in the construction of the primary spittoon 24. More specifically, the material should be compatible with ink such that it does not swell, leak, or deform upon contact with ink. Finally, the secondary spittoon 26 may also employ an absorbent material to enhance the evaporation of ink, similar to that employed in the primary spittoon 26 and described above.

In order to collect waste ink from the primary spittoon 24, an opening 46 is defined within a wall 48 of the primary spittoon 24. Preferably, the opening 46 is molded into the wall of the primary spittoon, as opposed to being cut out of the wall 48. This opening 46 should be located far enough below the top 50 of the wall 48 such that the threat of overflow is not imminent when waste ink accumulates within the primary spittoon 24 to the level at which the opening is placed. Preferably, the opening 46 is placed ranging from halfway to three-quarters of the way from the bottom 52 of the primary spittoon 24 to the top 50 of the wall 48, with two-thirds up the wall being most preferred.

Thus, when the level of waste ink reaches the opening 46, the waste ink will issue forth from the primary spittoon 24 through the opening, rather than continue to accumulate in the primary spittoon 24 and ultimately overflow in an uncontrolled fashion. The opening 46 may take any shape but is preferably circular to better accommodate the flow of ink. The diameter of the opening 46 preferably ranges from about 4 to 8 mm.

Waste ink issuing from the opening 46 is ultimately collected in the secondary spittoon 26 positioned below the primary spittoon 24, as portrayed in FIG. 3. More specifically, the secondary spittoon 26 is preferably placed in a cavity of the printer chassis under and behind the primary spittoon 24. The ink issuing from the opening 46 may be allowed to drip directly into the secondary spittoon 26 below. However, the waste ink is preferably routed toward collection in the secondary spittoon 26 by a passageway 54 of some sort, so that more control is retained over the direction of waste ink flow.

The passageway 54 may take the form of an enclosed tube or tunnel into which the waste ink issues from the opening 46, with the waste ink flowing out of the enclosed passageway into the secondary spittoon 26. However, such an embodiment would likely suffer from obstruction by dried ink, requiring frequent cleaning. In another embodiment, the passageway may take the form of an open channel along the wall of the primary spittoon 24, the channel having a diameter of about 2 to 4 mm. In yet another embodiment, and shown in FIG. 3 as the most preferable embodiment, the passageway 54 comprises a rib formed externally on the wall 48, with the end of the rib being positioned immediately below the opening 46 and extending in a substantially linear fashion to a point beyond the bottom 52 of the primary spittoon 24 and above the bottom 56 of the secondary spittoon 26. The rib 54 thus routes waste ink upon issuance from the opening 46 until the ink drops off the rib into the secondary spittoon 26 by force of naturally-occurring gravity. The ink travels along the rib 54 as a result of forces deriving from its surface tension and capillary action characteristics, which cause the surface of the ink to contract about the rib and migrate therealong.

If employed, the rib 54 may be constructed of any material suitable for contact with ink. Preferably, the material comprising the rib 54 is the same material used to form the primary spittoon 24. The rib 54 may be separately formed and then adhered to the wall 48 of the primary spittoon 24, but preferably it is molded onto the wall 48 of the primary spittoon as part of the construction of the primary spittoon itself. The length of the rib 54 will vary depending on such factors as the size of the primary spittoon 24, the placement of the opening 46, and the length of rib extending beyond the bottom 52 of the primary spittoon, the extension preferably ranging from approximately 3 to 5 mm. The thickness of the rib 54 may also vary depending on such factors as the diameter of the opening 46 as well as characteristics of the ink such as surface tension and viscosity. In the preferred embodiment, the thickness of the rib ranges from about 1 to 2 mm.

Thus, the practice of the present invention avoids uncontrolled overflows of waste ink from the primary spittoon 24. Contamination of the inside of the facsimile machine 10 is averted by simply strategically placing an opening 46 in the primary spittoon 24 such that ink spilling through the opening drops into a secondary spittoon 26. Even more control of the waste ink flow is obtained by employing a passageway to route the ink from the opening 46 to the secondary spittoon, the passageway preferably represented by the rib 54 formed externally on wall 48. To date, there are no known secondary spittoons employed.

INDUSTRIAL APPLICABILITY

The method of preventing ink overflow from the primary service station spittoons is expected to find use in thermal ink-jet devices, such as facsimile machines.

Thus, there has been disclosed an apparatus and method for preventing the contamination of the interior of the printer by ink that has overflowed the primary spittoon. It will be readily apparent to those skilled in this art that various changes and modifications of an obvious nature may be made, and all such changes and modifications may be made without departing from the scope of the invention, as defined by the appended claims.

What is claimed is:

1. A method of preventing the overflow of ink from a primary spittoon used in a service station of an ink-jet device, into which ink is jetted from nozzles of an ink-jet printhead in a print cartridge, said method comprising:

(a) providing a primary spittoon into which waste ink is jetted, said primary spittoon comprising a container having a bottom and side walls, each of said side walls having a top and at least one of said side walls having an opening through which said waste ink issues from said primary spittoon, thereby forming spillover ink, said primary spittoon secured in a fixed position;

(b) providing a secondary spittoon comprising a container having a bottom and side walls, fixedly secured beneath said primary spittoon;

(c) providing a passageway on said primary spittoon to route said spillover ink issued from said opening directly to said secondary spittoon such that said spillover ink routed by said passageway issues from said passageway into said secondary spittoon by force of naturally-occurring gravity; and (d) collecting said spillover ink issued from said primary spittoon in said secondary spittoon.

2. The method of claim 1 wherein said opening is located ranging from approximately halfway to three-quarters of the way from said bottom of said primary spittoon to said top of said at least one of said walls.

3. The method of claim 2 wherein said opening is located approximately two-thirds of the way from said bottom of said primary spittoon to said top of said at least one of said walls.

4. The method of claim 1 wherein said opening is approximately circular in shape, having a diameter ranging from about 4 to 8 mm.

5. The method of claim 1 wherein said secondary spittoon has a volume ranging from about 10 to 20 $cm^3$.

6. The method of claim 1 wherein said passageway comprises a rib formed externally on said at least one of said walls, said rib having a first end and a second end, whereby said first end of said rib is positioned immediately below said opening with the rib extending beyond said bottom of said primary spittoon, said second end of said rib thereby positioned lower than said bottom of said primary spittoon and over said secondary spittoon.

7. The method of claim 6 wherein said rib is substantially linear between said first end and said second end and has a thickness ranging from about 1 to 2 mm.

8. The method of claim 1 wherein said passageway comprises an enclosed passageway, said enclosed passageway having a first open end and a second open end, wherein said first open end receives said spillover ink into said enclosed passageway, with said spillover ink subsequently issuing from said second open end of said enclosed passageway.

9. A method of preventing the overflow of ink from a primary spittoon used in a service station of an ink-jet device, into which ink is jetted from nozzles of an ink-jet printhead in a print cartridge, said method comprising (a) providing a primary spittoon into which waste ink is jetted, said primary spittoon comprising a container having a bottom and side walls, each of said side walls having a top and at least one of said side walls having an opening located approximately two-thirds of the way from said bottom of said primary spittoon to said top of said at least one of said side walls, said opening being approximately circular in shape and having a diameter ranging from about 4 to 8 mm, said waste ink issuing from said opening to form spillover ink, said primary spittoon secured in a fixed position;

(b) providing a rib formed externally on said at least one of said side walls, said rib having a first end and a second end, said rib being substantially linear between said first end and said second end and having a thickness ranging from about 1 to 2 mm, said first end being positioned immediately below said opening with said rib extending beyond said bottom of said primary spittoon, said second end of said rib thereby positioned lower than said bottom of said primary spittoon, said rib serving to route said spillover ink issued from said opening;

(c) providing a secondary spittoon comprising a container having a bottom and side walls, fixedly secured below said second end of said rib of said primary spittoon, such that said spillover ink routed by said passageway issues from said passageway directly into said secondary spittoon by force of naturally-occurring gravity: and (d) collecting said spillover ink issued from said rib in said secondary spittoon, said secondary spittoon having a volume ranging from about 10 to 20 $cm^3$.

10. A facsimile machine including an ink-jet print cartridge and means for printing received transmission, said facsimile machine further including a service station for servicing said print cartridge, said service station including:

(a) a primary spittoon into which ink from said print cartridge is periodically spit by nozzles in said print cartridge, said primary spittoon comprising a container having a bottom and side walls, each of said side walls having a top and at least one of said side walls having an opening through which said ink issues from said primary spittoon, thereby forming spillover inks said primary spittoon secured in a fixed position;

(b) a passageway on said primary spittoon to route said spillover ink issued from said opening: and (c) a secondary spittoon into which said spillover ink from said passageway on said primary spittoon is collected, said secondary spittoon comprising a container having a bottom and side walls said secondary spittoon fixedly secured beneath said primary spittoon, such that said spillover ink routed by said passageway issues directly from said passageway into said secondary spittoon by force of naturally-occurring gravity.

11. The facsimile machine of claim 10 wherein said passageway comprises an enclosed passageway, said enclosed passageway having a first open end and a second open end, wherein said first open end of said enclosed passageway receives said spillover ink into said enclosed passageway and said second open end of said enclosed passageway allows said spillover ink to issue from said enclosed passageway.

12. The facsimile machine of claim 10 wherein said passageway comprises a channel defined on said at least one of said walls, said channel having a first end and a second end and a thickness of within the range of about 2 to 4 mm, wherein said first end receives said spillover ink into said channel, with said spillover ink subsequently issuing from said second end of said channel.

13. The facsimile machine of claim 10 wherein said secondary spittoon has a volume ranging from about 10 to 20 $cm^3$.

14. The facsimile machine of claim 10 wherein said opening is located ranging from approximately halfway to three-quarters of the way from said bottom of said primary spittoon to said top of said at least one of said walls, said opening being approximately circular in shape and having a diameter ranging from about 4 to 8 mm.

15. The facsimile machine of claim 14 wherein said opening is located approximately two-thirds of the way from said bottom of said primary spittoon to said top of said at least one of said walls.

16. The facsimile machine of claim 10 wherein said passageway comprises a rib formed externally on said at least one of said walls, said rib having a first end and second end and being substantially linear between said first end and said second end, whereby said first end of said rib is positioned immediately below said opening with said rib extending beyond said bottom of said primary spittoon, said second end of said rib thereby positioned lower than said bottom of said primary spittoon and over said secondary spittoon.

17. The facsimile machine of claim 16 wherein said rib is substantially linear between said first end and said second end and has a thickness ranging from about 1 to 2 mm.

18. The method of claim 1 wherein said passageway comprises a channel defined on said at least one of said walls, said channel having a first end and a second end and a thickness of within the range of about 2 to 4 mm, wherein said first end receives said spillover ink into said channel, with said spillover ink subsequently issuing from said second end of said channel.

19. A facsimile machine including an ink-jet print cartridge and means for printing received transmission, said facsimile machine further including a service station for servicing said print cartridge, said service station including:

(a) a primary spittoon into which ink from said print cartridge is periodically spit by nozzles in said print cartridge, said primary spittoon comprising a container having a bottom and side walls, each of said side walls having a top and at least one of said side walls having an opening located approximately two-thirds of the way from said bottom of said primary spittoon to said top of said at least one of said side walls, said opening being roughly circular in shape and having a diameter ranging from about 4 to 8 mm, said ink issuing from said opening to form spillover inks said primary spittoon secured in a fixed position;

(b) a rib formed externally on said at least one of said side walls, said rib having a first end and a second end, said rib being substantially linear between said first end and said second end and having a thickness ranging from about 1 to 2 mm, said first end being positioned immediately below said opening with said rib extending beyond said bottom of said primary spittoon, said second end of said rib thereby positioned lower that said bottom of said primary spittoon, said rib serving to route said spillover ink issued from said opening; and (c) a secondary spittoon into which said spillover ink issued from said rib is collected, said secondary spittoon comprising a container having a bottom and side walls and having a volume ranging from about 10 to 20 $cm^3$, said secondary spittoon being fixedly positioned below said second end of said rib such that said spillover ink issues directly from said second end of said rib into said secondary spittoon by force of naturally-occurring gravity.

* * * * *